US007647018B2

(12) United States Patent
Moore et al.

(10) Patent No.: US 7,647,018 B2
(45) Date of Patent: Jan. 12, 2010

(54) PRINTING SYSTEM

(75) Inventors: Steven R. Moore, Rochester, NY (US); Joannes N. M. de Jong, Hopewell Junction, NY (US); Matthew Dondiego, West Milford, NJ (US); Vittorio Castelli, Yorktown Heights, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 880 days.

(21) Appl. No.: 11/189,371

(22) Filed: Jul. 26, 2005

(65) Prior Publication Data

US 2007/0024894 A1 Feb. 1, 2007

(51) Int. Cl.
*G03G 15/00* (2006.01)

(52) U.S. Cl. ..... 399/390; 399/82; 399/68

(58) Field of Classification Search ..... 358/1.1–1.16; 399/67, 68, 82, 328, 321, 322, 330, 233, 399/122, 320, 390
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Benny Q Tieu
*Assistant Examiner*—Michael Tzeng
(74) *Attorney, Agent, or Firm*—Fay Sharpe LLP

(57) ABSTRACT

A printing system and method is provided. The printing system includes one or more printing system modules, at least one media sheet path interfacing the printing system modules, and a job scheduler for executing one or more printing system print jobs. The job scheduler routes a media sheet to one or more printing system modules for preshrinking or preenlarging without marking and subsequently routes the preshrunk or preenlarged media sheet to one or more printing system modules for marking. The method of printing includes generating a print job to be printed using one or more printing system modules. Print jobs requiring two or more printing system modules for marking are executed by routing a media sheet to one or more printing system modules for preshrinking or preenlarging without marking, and subsequently routing the preshrunk or preenlarged media sheet to the one or more printing modules for marking.

17 Claims, 13 Drawing Sheets

U.S. PATENT DOCUMENTS

| | | | |
|---|---|---|---|
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |
| 5,778,377 | A | 7/1998 | Marlin et al. |
| 5,884,910 | A | 3/1999 | Mandel |
| 5,995,721 | A | 11/1999 | Rourke et al. |
| 6,059,284 | A | 5/2000 | Wolf et al. |
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |
| 6,384,918 | B1 | 5/2002 | Hubble, III et al. |
| 6,450,711 | B1 | 9/2002 | Conrow |
| 6,476,376 | B1 | 11/2002 | Biegelsen et al. |
| 6,476,923 | B1 | 11/2002 | Cornell |
| 6,493,098 | B1 | 12/2002 | Cornell |
| 6,537,910 | B1 | 3/2003 | Burke et al. |
| 6,550,762 | B2 | 4/2003 | Stoll |
| 6,554,276 | B2 | 4/2003 | Jackson et al. |
| 6,577,925 | B1 | 6/2003 | Fromherz |
| 6,607,320 | B2 | 8/2003 | Bobrow et al. |
| 6,608,988 | B2 | 8/2003 | Conrow |
| 6,612,566 | B2 | 9/2003 | Stoll |
| 6,612,571 | B2 | 9/2003 | Rider |
| 6,621,576 | B2 | 9/2003 | Tandon et al. |
| 6,633,382 | B2 | 10/2003 | Hubble, III et al. |
| 6,639,669 | B2 | 10/2003 | Hubble, III et al. |
| 6,819,906 | B1 | 11/2004 | Herrmann et al. |
| 2002/0078012 | A1 | 6/2002 | Ryan et al. |
| 2002/0103559 | A1 | 8/2002 | Gartstein |
| 2002/0131800 | A1* | 9/2002 | Jacob et al. ..... 399/390 |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz et al. |
| 2004/0150158 | A1 | 8/2004 | Biegelsen et al. |
| 2004/0153983 | A1 | 8/2004 | McMillan |
| 2004/0216002 | A1 | 10/2004 | Fromherz et al. |
| 2004/0225391 | A1 | 11/2004 | Fromherz et al. |
| 2004/0225394 | A1 | 11/2004 | Fromherz et al. |
| 2004/0247365 | A1 | 12/2004 | Lofthus et al. |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 30, 2004, Bobrow.
U.S. Appl. No. 10/917,676, filed Aug. 13, 2004, Lofthus, et al.
U.S. Appl. No. 10/917,768, filed Aug. 13, 2994, Lofthus, et al.
U.S. Appl. No. 10/934,106, filed Aug. 23, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 23, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus,et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001/890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus, et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz, et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/102,332, filed Apr. 8, 2005, Hindi, et al.
U.S. Appl. No. 11/136,959, filed May 25, 2005, German, et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus, et al.
U.S. Appl. No. 11/137,251, filed May 25, 2005, Lofthus, et al.
U.S. Appl. No. 11/137,273, filed May 25, 2005, Anderson, et al.
U.S. Appl. No. 11/152,275, filed Jun. 14, 2005, Roof, et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal, et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166/460, filed Jun. 24, 2005, Roof, et al.
U.S. Appl. No. 11/166,581, filed Jun. 24, 2005, Lang, et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.

* cited by examiner

PRINTING SYSTEM

BACKGROUND

The present disclosure relates to preshrinking and preenlarging of sheets for improved image registration as applied to printing systems. It finds particular application in conjunction with overlay printing and integrated printing modules consisting of several marking engines, each having the same or different printing capabilities, and will be described with particular reference thereto. However, it is to be appreciated that the present disclosure is also amenable to other like applications.

Overlay printing is a printing method whereby a first marking engine prints content on one side of a sheet, and then a second marking engine with different capability prints complimentary content on the same side. In fact, it is possible that monochrome content, CMYK 4-color content, and custom color content could all be desired on the same side of a sheet, such that a given sheet passes through three different marking engines. When consecutively marking a sheet using multiple marking engines, the need to properly register the image content from the different marking engines becomes a factor which affects the overall quality of the printed sheet and ultimately customer satisfaction. The accuracy of registering a sheet for subsequent making can be a function of many systems, including but not limited to sheet control, sheet dimension stability and/or predictability, marking engine control, etc.

This disclosure relates to sheet dimension stability; specifically, the shrinkage or enlargement of a media sheet as it passes through a marking engine. As a sheet is passed through a first marking engine for image marking, the sheet will shrink or enlarge and thereby cause a second marking of the sheet to be misaligned. The third marking of the sheet will also be misaligned as a function of the amount the sheet shrinks or enlarges during the first and second markings. As the sheet passes through subsequent marking engines, additional sheet registration error will occur as a result of the shrinkage or enlargement of the sheet through each marking engine. Depending on the cumulative amount of shrinkage or enlargement, the finished overlay printed sheet can have a noticeable registration misalignment of images and create a lower degree of customer satisfaction with the finished product. This disclosure provides a way to compensate for the cumulative media shrinkage or enlargement discussed heretofore by sending a sheet initially through one or more nonprinting cycles before commencing one or marking operations.

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. dejong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE. SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. dejong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P application Ser. No. 11/137,273, filed May 25, 2005, entitled "PRINTING SYSTEM", by David G. Anderson et al.;

U.S. application Ser. No. 11/143,818, filed Jun. 2, 2005, entitled "INTER-SEPARATION DECORRELATOR", by Edul N. Dalal et al.;

U.S. application Ser. No. 11/146,665, filed Jun. 7, 2005, entitled "LOW COST ADJUSTMENT METHOD FOR PRINTING SYSTEMS", by Michael C. Mongeon;

U.S. application Ser. No. 11/152,275, filed Jun. 14, 2005, entitled "WARM-UP OF MULTIPLE INTEGRATED MARKING ENGINES", by Bryan J. Roof et al.;

U.S. application Ser. No. 11/156,778, filed Jun. 20, 2005, entitled "PRINTING PLATFORM", by Joseph A. Swift;

U.S. application Ser. No. 11/157,598, filed Jun. 21, 2005, entitled "METHOD OF ORDERING JOB QUEUE OF MARKING SYSTEMS", by Neil A. Frankel; and

BRIEF DESCRIPTION

Aspects of the present disclosure and embodiments thereof include a printing system and method. In one aspect of the disclosure, a printing system is provided including at least two printing system modules; at least one media sheet path interfacing the printing system modules; and a job scheduler for executing one or more printing system print jobs, the job scheduler routing a media sheet to one or more printing system modules for preshrinking or preenlarging without marking and subsequently routing the preshrunk or preenlarged media sheet to one or more printing system modules for marking.

Another aspect includes a method of printing. The method includes generating a print job to be printed using at one printing system module, and analyzing the image content of the print job and determining if the print job requires a media sheet to be marked using two or more printing system modules or the print job requires a media sheet to be marked using only one printing system module. Print jobs requiring two or more printing system modules for marking are executed by routing a media sheet to one or more printing system modules for preshrinking or preenlarging without marking, and subsequently routing the preshrunk or preenlarged media sheet to the one or more printing modules for marking. Print jobs requiring only one printing system module for marking, are executed by routing a media sheet to a printing module for marking.

Another aspect of the disclosure includes a xerographic system. The xerographic system including a media sheet feeder module and a plurality of horizontally and vertically integrated marking devices for applying images to print media. The plurality of marking engines includes a black and white marking engine, a color marking engine, and a marking engine and/or a fuser without a marking engine. A media sheet path includes a lower highway and/or an upper highway, and a return highway. The highways are integrated with the plurality of integrated marking devices, a feeder module, and a finisher module. A job scheduler executes one or more printing system print jobs, the job scheduler capable of routing a media sheet to one or more printing system modules for preshrinking or preenlarging without marking and subsequently routing the preshrunk or preenlarged media sheet to one or more printing system modules for marking. Print jobs having sheets requiring black and white printing, and color printing include a media sheet preshrinking or preenlarging process. The media sheet preshrinking or preenlarging process routes a media sheet from the sheet feeder module to a printing system module for processing the media sheet without marking. Subsequently, the preshrunk or preenlarged media sheet is routed to a printing system module for black and white marking. The media sheet is subsequently routed to another printing system module for color marking. After printing is completed the media sheet is routed to the finisher module. As an alternative, the media sheet can be routed to a color painting system module for color marking, and subsequently to a black and white printing module for black and white marking.

DETAILED DESCRIPTION

Printing systems including multiple xerographic marking engines have the ability to print images on one or two sides of a sheet using multiple image marking engines. The process of overlay printing is sensitive to the accurate registration of the media sheet as it is marked by multiple image marking engines. A significant factor affecting the media sheet registration, relative to multiple marking engines, is the dimensional stability of the media sheet as it is processed through the multiple image marking engines.

The detailed description which follows describes a printing system which preshrinks media sheets prior to subsequent image marking for improved image registration. The exemplary embodiments described relate to the media sheets that shrink as they pass through an image marking engine or fuser. However, the exemplary embodiments described are equally applicable to media sheets that enlarge as they pass through an image marking engine or fuser.

Figure 1:
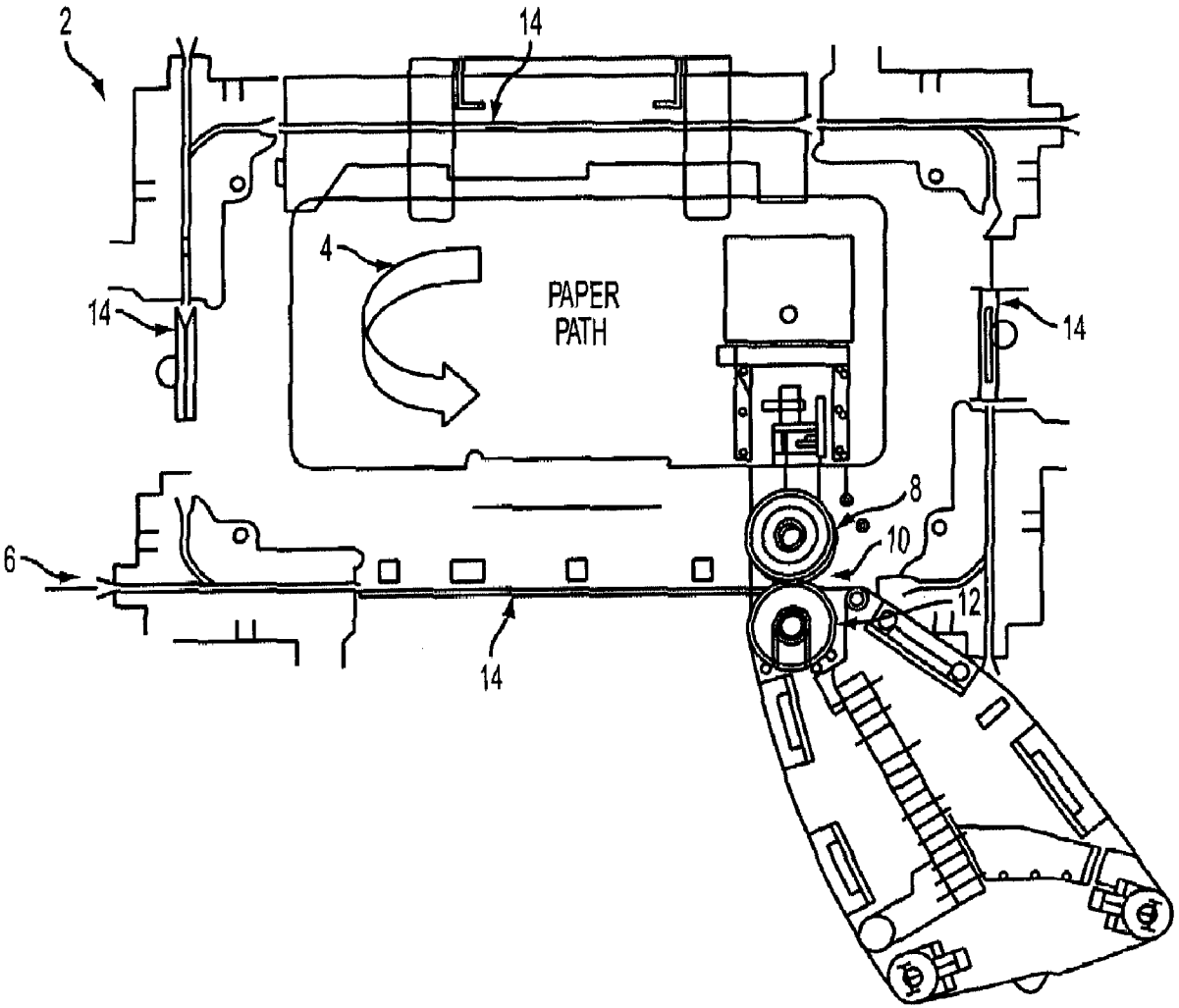
FIG. 1 is an illumination of a printing device used to acquire media shrinkage data.

With reference to FIG. 1, illustrated is a printing fixture 2 used to determine the amount of media sheet shrinkage associated with each pass of a sheet through a marking engine. As illustrated, the printing fixture 2 includes a cyclical sheet path 4, this sheet path including an initial sheet feed 6, a pressure roll 8, a transfuse nip 10, a heated fuser roll 12 and a sheet path 14. FIG. 2, FIG. 3A, FIG. 3B, FIG. 4A, FIG. 4B, FIG. 5A and FIG. 5B graphically represent shrinkage data obtained from the print fixture illustrated in FIG. 1.

To obtain media sheet shrinkage data, a paper sheet was fed into the sheet feed 6 and routed through the transfuse nip 10. The transfuse nip 10 includes a pressure roll 8 and a heated fuser roll 12. After passing through the transfuse nip 10, the paper sheet traveled along the sheet path 4 indicated in FIG. 1 and was cycled through the transfuse nip 10 a second time. This cycle was repeated several times to obtain media sheet length and width dimensional changes as a function of passes through the transfuse nip 10 at a given temperature, pressure as applied by the pressure roll 8 and process speed.

The graphical illustrations of media sheet shrinkage as a function of transfuse nip passes establish that a majority of the cumulative media shrinkage can be compensated by routing a media sheet initially through one or more non-printing marking engines and subsequently marking the media sheet with a plurality of marking engines.

Figure 2:
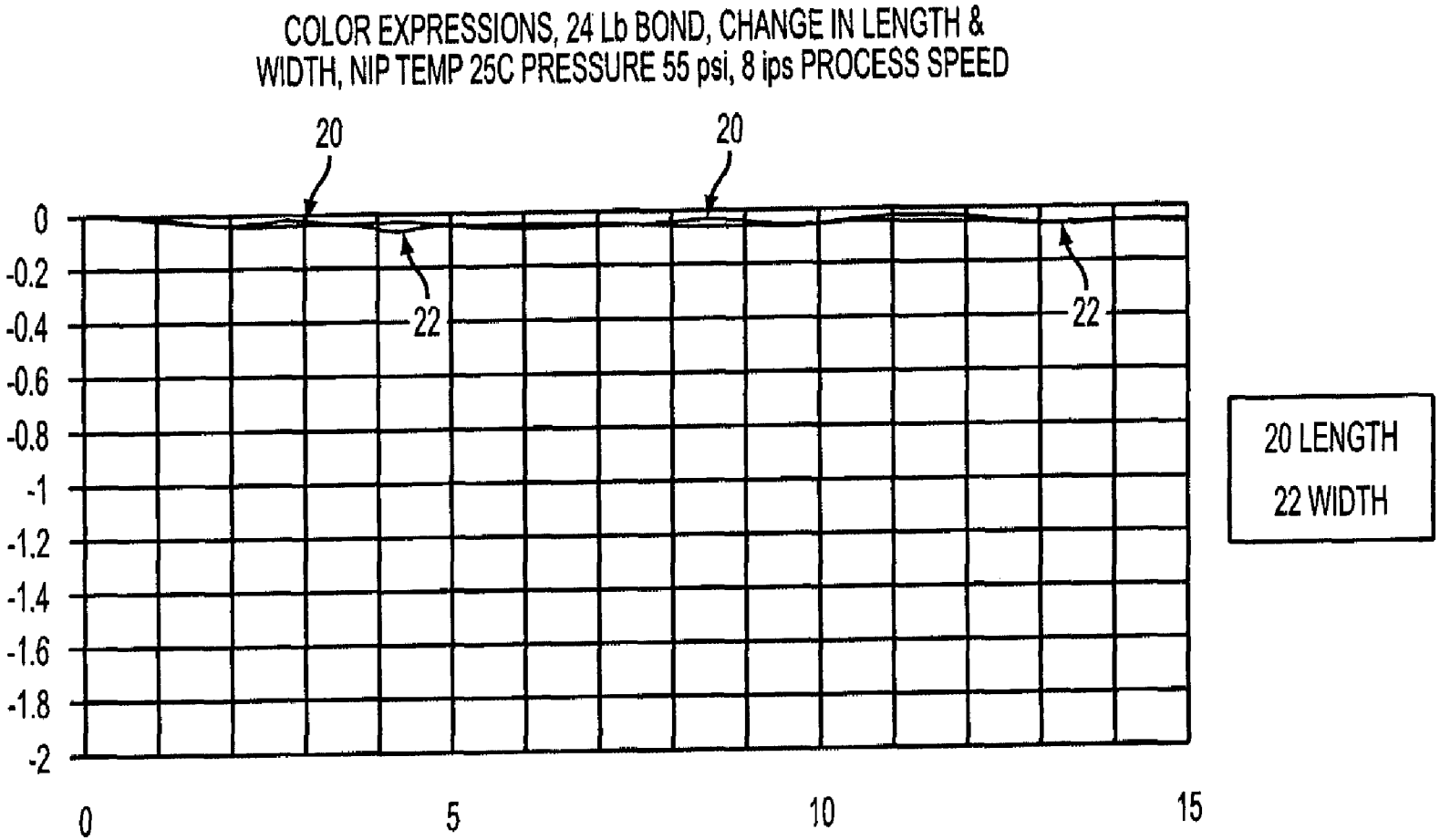
FIG. 2 is a graphical representation of media shrinkage data.
Figure 3A:
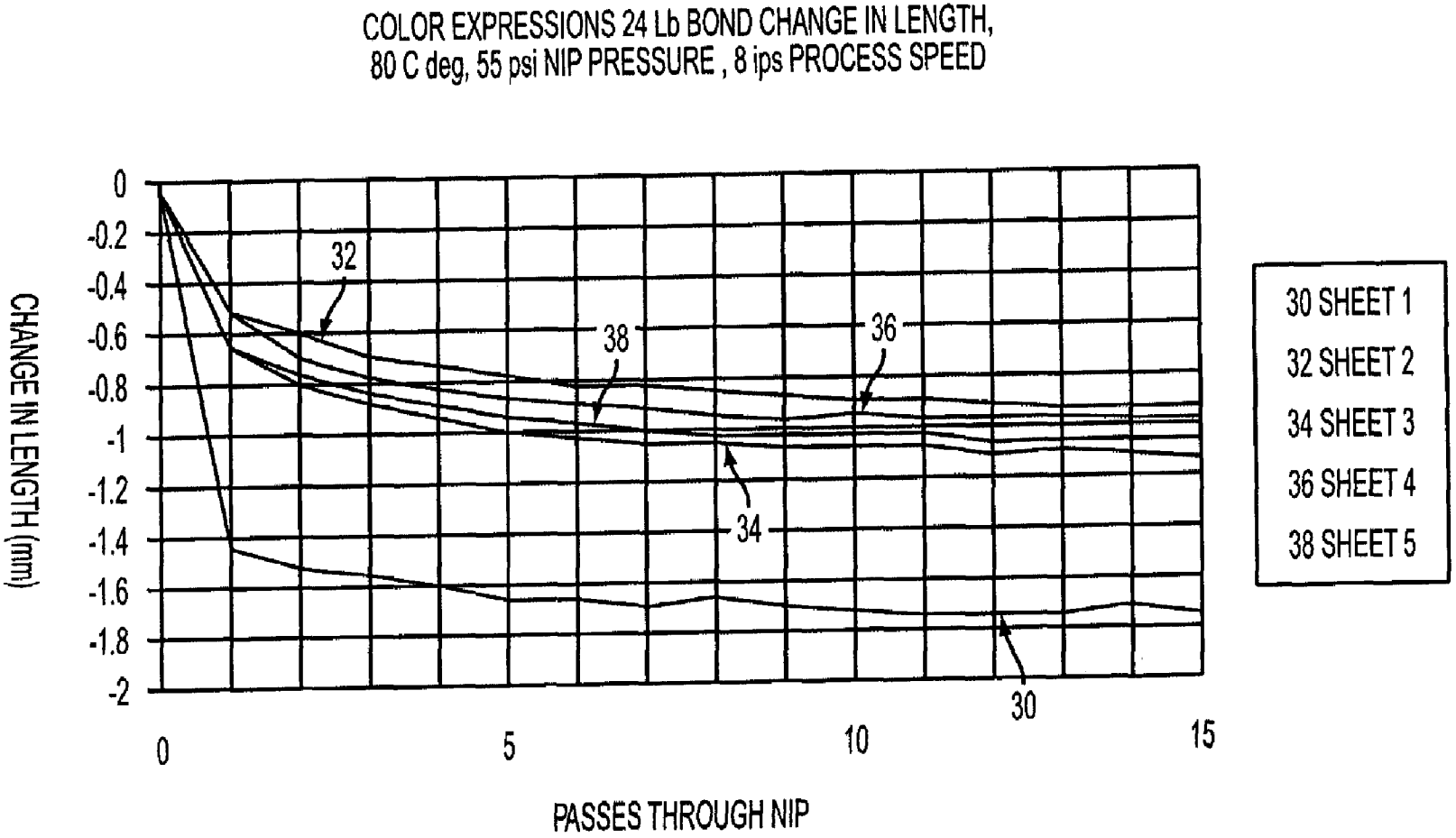
FIGS. 3A and 3B are graphical representations of media shrinkage data.
Figure 3B:
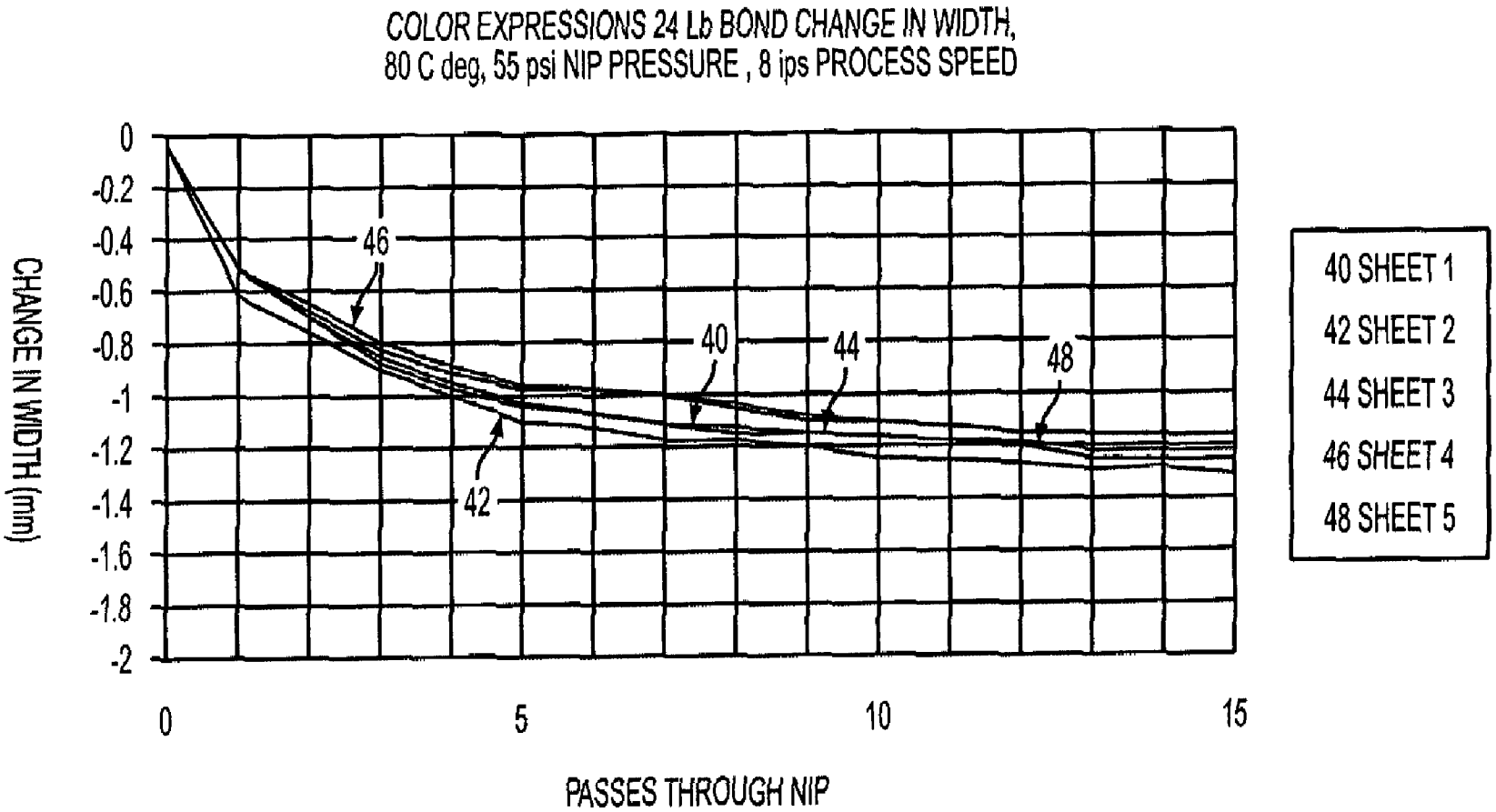
Figure 4A:
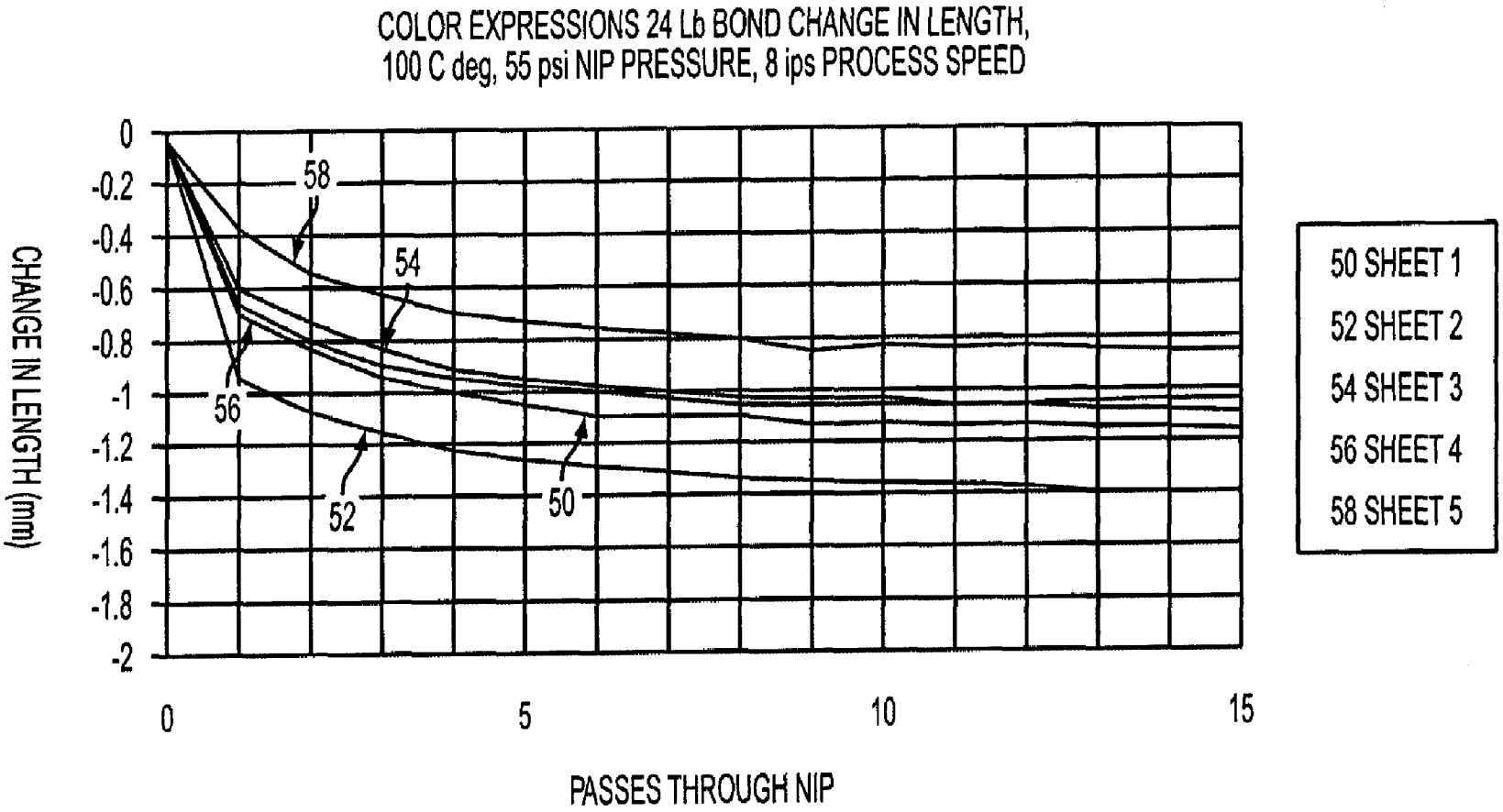
FIGS. 4A and 4B are graphical representations of media shrinkage data.
Figure 4B:
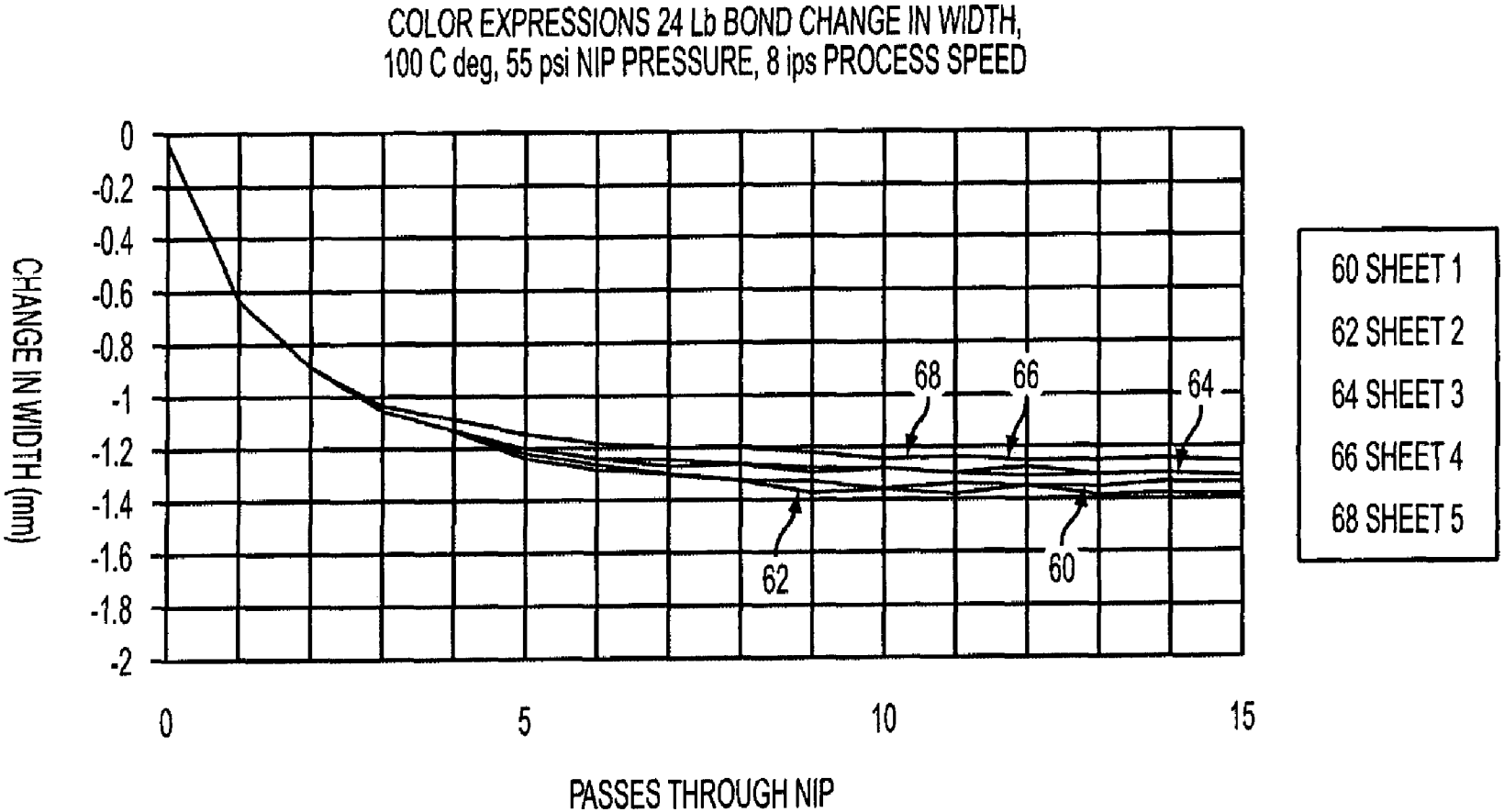
Figure 5A:
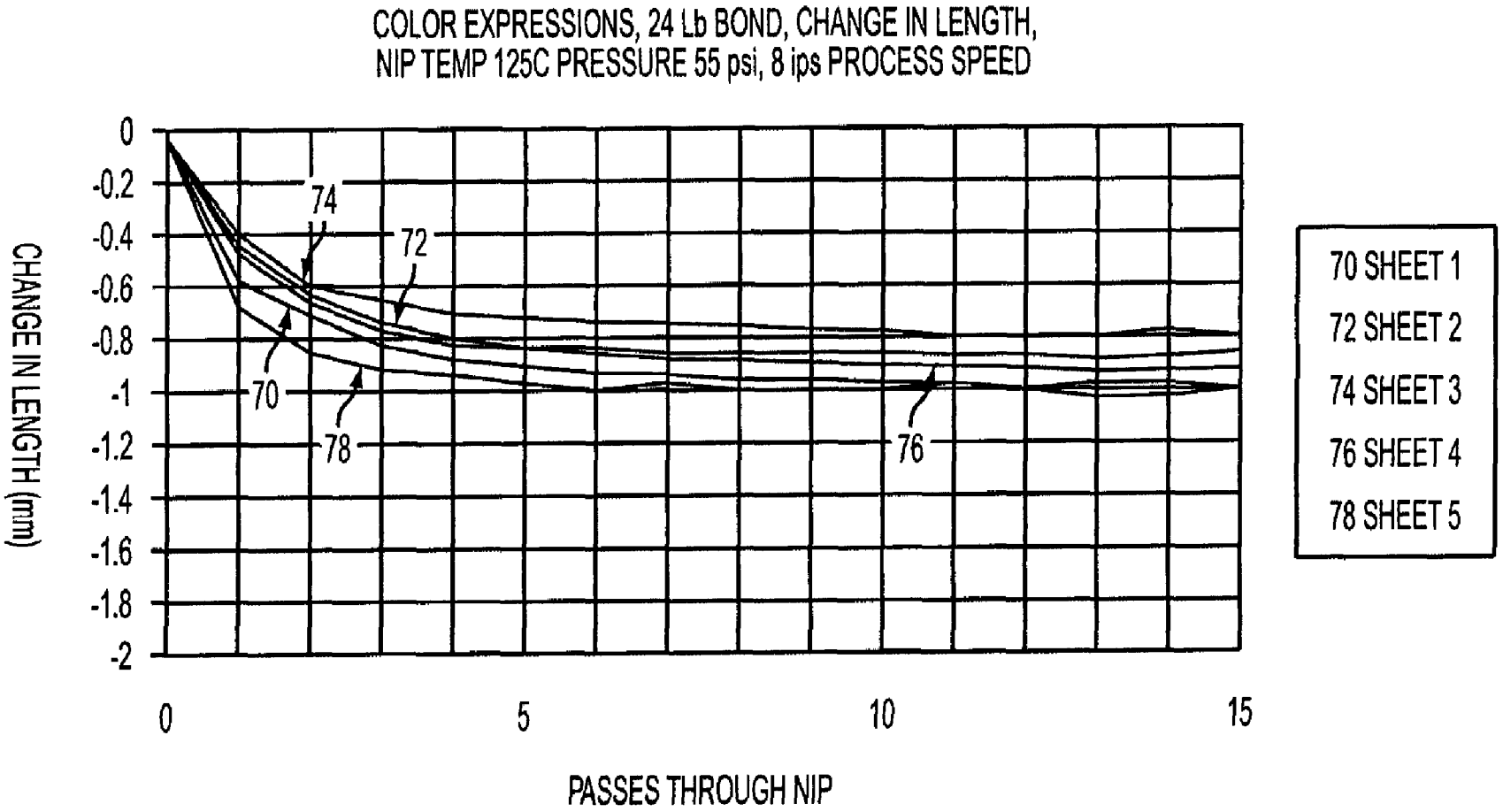
FIGS. 5A and 5B are graphical representations of media shrinkage data.
Figure 5B:
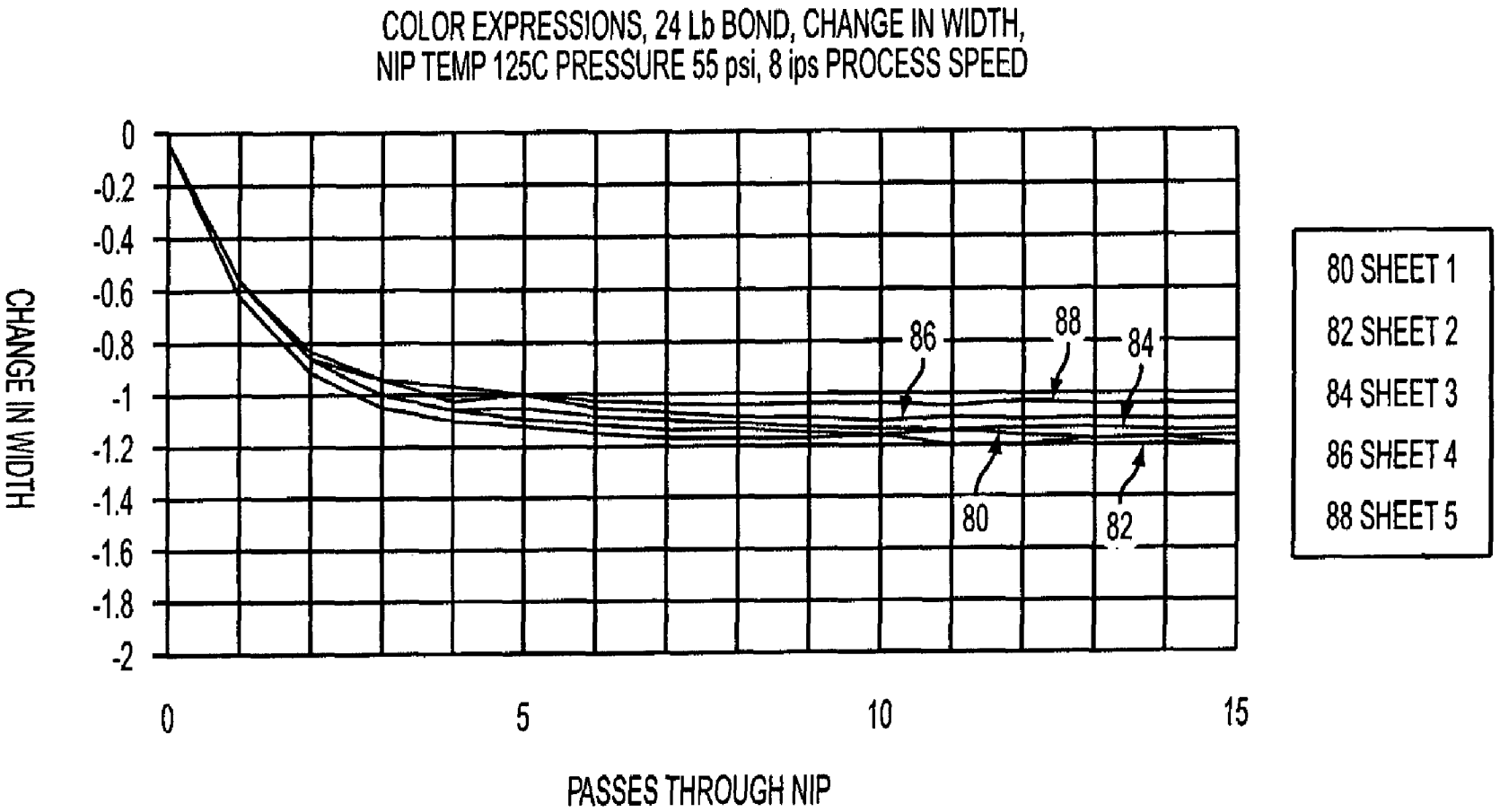

FIG. 2 illustrates very little change of the length 20 and width 22 dimensions of a paper sheet with a transfuse nip temperature of 25° C. and transfuse pressure of 55 ps. However, as the transfuse temperature is increased while maintaining a constant transfuse nip pressure and process speed, the length and width dimensions of the paper sheet decrease with each successive pass through the transfuse nip. FIG. 3A and FIG. 3B illustrate the length and width dimensional changes, respectively, of paper sheets 30, 32, 34, 36, 38, 40, 42, 44, 46 and 48 with a transfuse nip temperature of 80° C. FIG. 4A and FIG. 4B illustrate the dimensional length and width changes, respectively, of paper sheets 50, 52, 54, 56, 58, 60, 62, 64, 6-6 and 68 with a transfuse nip temperature of 100° C. FIG. 5A and FIG. 5B illustrate the length and width dimensional changes, respectively, of paper sheets 70, 72, 74, 76, 78, 80, 82, 84, 86 and 88 with a transfuse nip temperature of 125° C.

In addition to the discussion heretofore, the graphs of FIG. 3A, FIG. 3B, FIG. 4A, FIG. 4B, FIG. 5A and FIG. 5B illustrate after the first 5-6 passes through the fuser nip, little or no subsequent media sheet shrinkage occurs. This is most likely because the sheet moisture content has reached its minimum steady state value given the ambient relative humidity.

Referencing FIG. 5A and FIG. 5B, approximately 80% of total media sheet shrinkage occurs during the initial 1-2 passes through a fusing system. Therefore, if the total shrinkage is approximately 1 mm, as illustrated in FIG. 5A and FIG. 5B, with multiple passes through a fuser, 0.8 mm of shrinkage will occur during the media sheets initial 1-2 passes or preshrinking process, and 0.2 mm will be seen as a residual alignment error between various content planes associated with the overlay marking after the preshrinking process is completed. This 0.2 mm error has been determined to be acceptable print quality.

Those of skill in the art will appreciate other combinations of preshrinking process passes through the fusing nip of a non-printing marking engine before routing the preshrunk media sheet to a series of marking engines for overlay printing. The greater the number of preshrinking passes through the fusing nip, the smaller the amount of registration error during the subsequent image marking processes because the dimensional stability of the media sheet increase. However, the lesser the amount of preshrinking passes through the fusing nip, the greater the process efficiency of the overall printing system.

Figure 6:
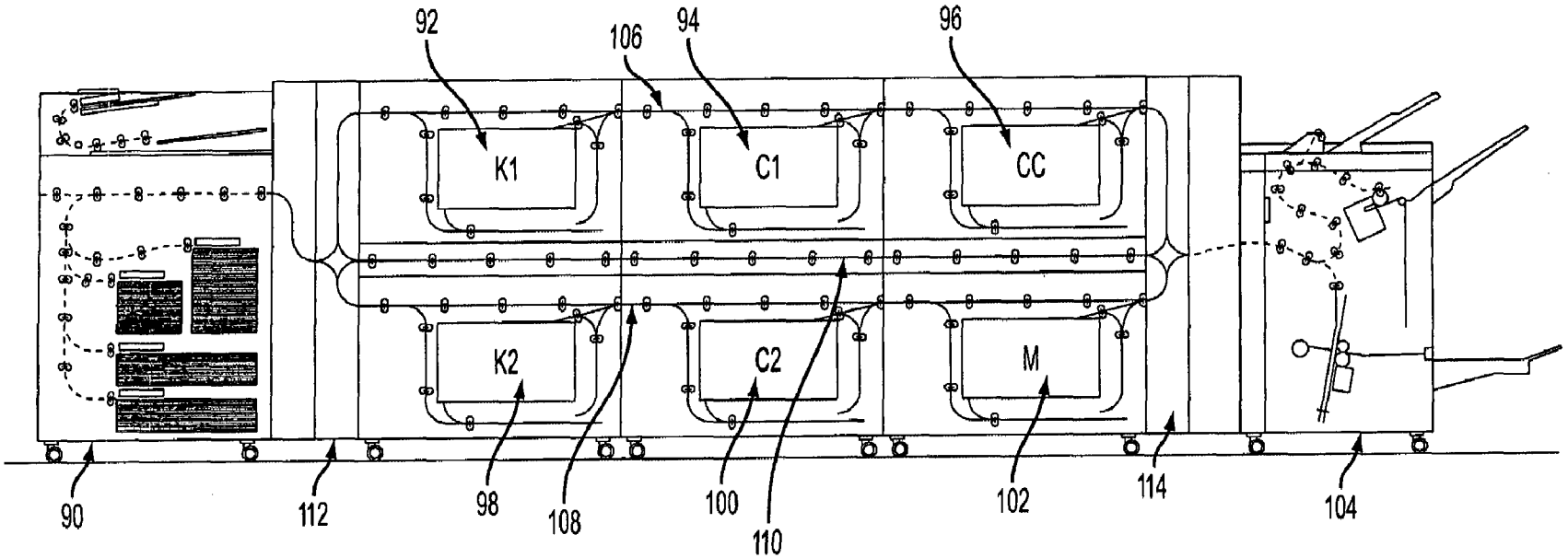
FIG. 6 is a schematic illustration of an exemplary printing system incorporating a media sheet preshrinking or preenlarging process.

With reference to FIGS. 6-10, exemplary embodiments of the present disclosure will be described. With reference to FIG. 6, illustrated is a printing system including a media sheet feeder module 90, a plurality of horizontally and vertically integrated marking devices 92, 94, 96, 98,100, and 102, a finisher module 104 and a media sheet path including an upper highway 106, a lower highway 108 and a return path 110. In addition, an input transport module 112 and an output transport module 114 integrate the feeder module 90 and finisher module 104, respectively, to the media sheet path structure. The printing system is connected to a data source (not shown) which provides print job data and controls the execution of print jobs. In addition, a job scheduler module (not shown) provides the necessary control to select which printing system modules will be utilized for a particular print job.

To provide printing flexibility and overlay printing ability, the exemplary embodiment of FIG. 6 includes color image marking engines 94 and 100, black and white image marking engines 92 and 98, a MICR image marking engine 102 and a custom color image marking engine 96.

Figure 7:
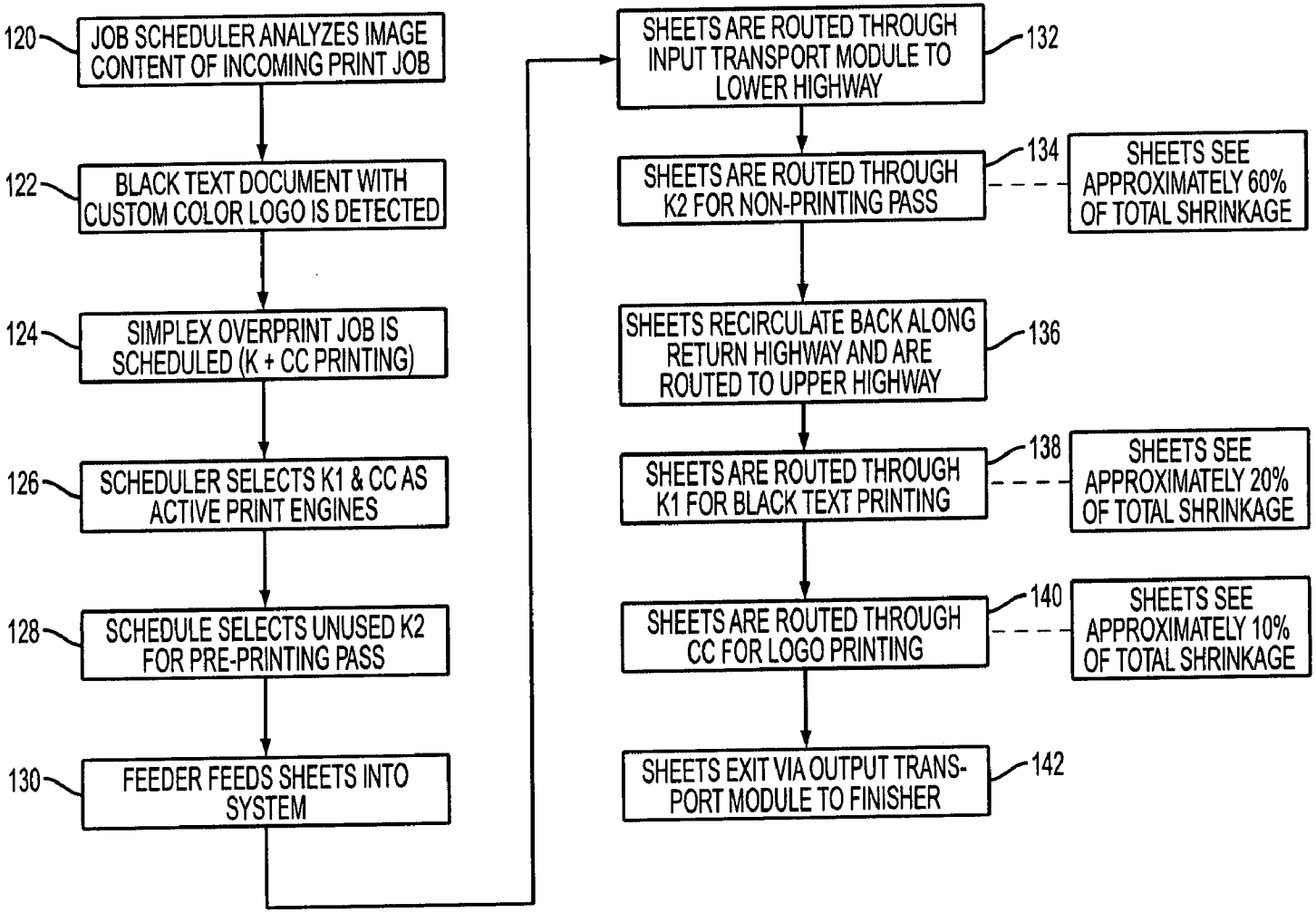
FIG. 7 is a flow chart illustration of an exemplary printing system incorporating a media sheet preshrinking or preenlarging process.

Referencing FIG. 7, a detailed method of operating the embodiment of FIG. 6 is explained. FIG. 7 illustrates the flow chart of an overlay printing job which includes black text and a custom color logo. The initial print job data is transmitted to the printing system by a network, pc, cd, or other computer readable medium or device. The job scheduler analyzes the image content of the incoming print job 120 to determine if multiple image marking engines are required to complete the print job. In this example, a black text document with custom color is detected 122 Subsequently, the job scheduler schedules 124 and allocates 126 a black and white text marking engine 92 and a custom color marking engine 96 to perform the simplex overprint job 124. The job scheduler next selects unused black text printing module K2 98 for preprinting or preshrinking passes 128. It is to be understood that the job scheduler could have selected any unused printing module, (i.e., image marking engine, fuser, etc.) to perform the preprinting pass. After the job scheduler has allocated the proper printing modules to complete the job, the media sheet feeder feeds the required sheets into the printing system 130. Sheets are routed through the input transport module to the lower highway 132 and routed to printing module K2 98 media sheet input for preshrinking 134 within printing module K2, which includes a fuser. After passing through the fuser, the media object will be shrunk approximately 60% 134 of the total shrinkage potential. Next, the media sheet is routed from the media sheet output of printing module K2 along the lower highway and re-circulated back along the return highway 136. Subsequently, the media sheet is routed along the upper highway to printing module K1 for black text printing 138. After the sheet passes through the black text image marking engine K1, the sheet will be shrunk approximately 80% of the total shrinkage potential. Next, the sheet is routed through the custom color printing module CC for logo printing 140. Total shrinkage of the media sheet is approximately 90% of total shrinkage potential after printing has been completed. In addition, the media sheet only shrinks approximately 20% after the black text is marked on the sheet and a subsequent custom color is marked on the sheet. The net effect of this process is a reduction of mis-registration error relative to the images printed on the media sheet. Subsequent to image marking by printing module CC, the media sheet is routed to the output transport module by the upper highway and from the output transport module to the finisher module 142.

Figure 8:
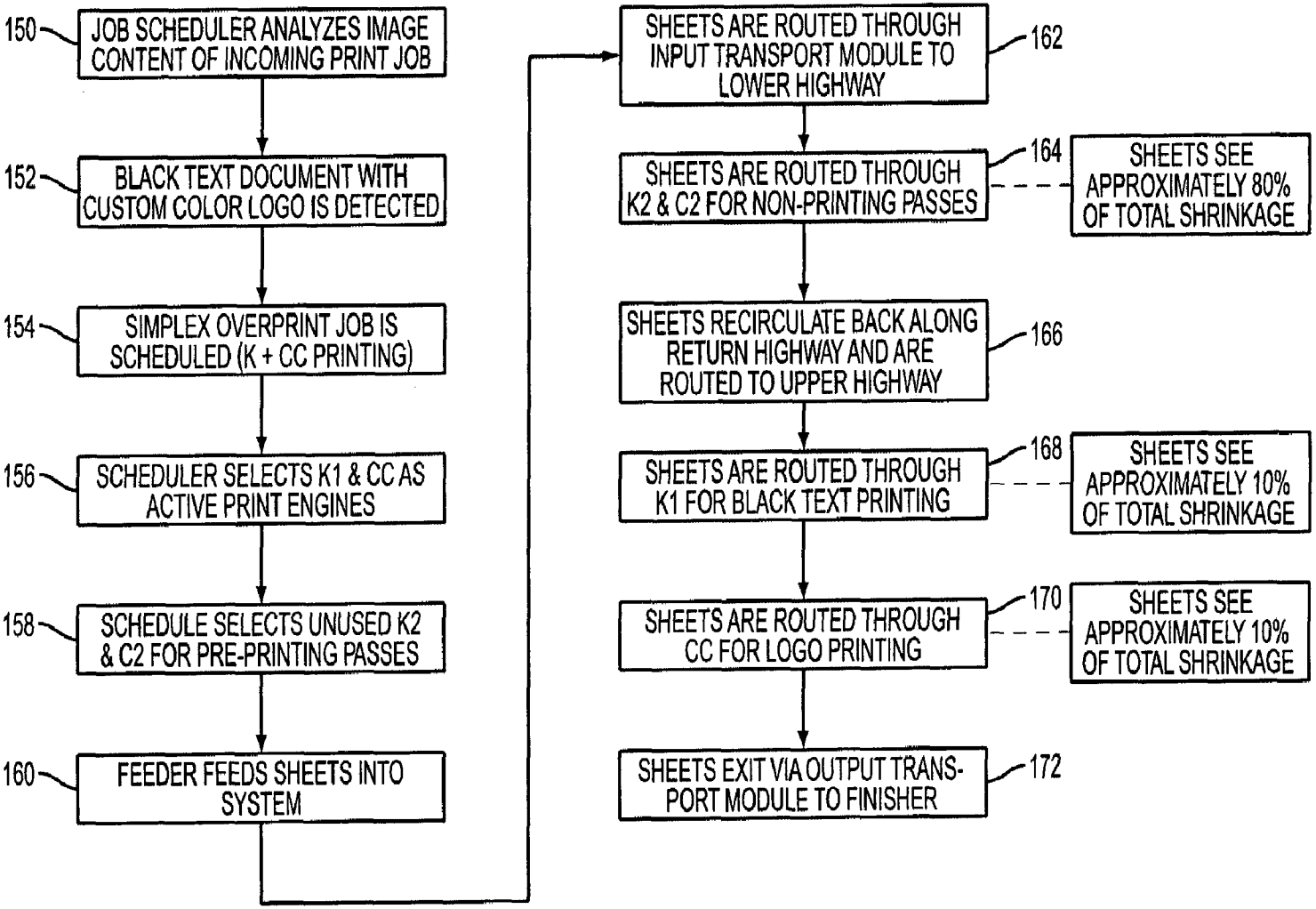
FIG. 8 is a flow chart illustration of an exemplary printing system incorporating a media sheet preshrinking or preenlarging process.

Referencing FIG. 8, another detailed method of operating the embodiment of FIG. 6 will be explained. FIG. 8 illustrates the flow chart of an overlay printing job which includes black text and a custom color logo. The initial print job data is transmitted to the printing system by a network, pc, cd, or other computer readable medium or device. The job scheduler analyzes the image content of the incoming print job 150 to determine if multiple image marking engines are required to complete the print job. In this example, a black text document with custom color is detected 152. Subsequently, the job scheduler schedules 154 and allocates a black text marking engine K1 and a custom color marking engine CC 156 to perform the simplex overlay print job. The job scheduler next selects unused printing modules K2 and C2 for preprinting or preshrinking passes 158. It is to be understood that the job scheduler can select any unused printing module (i.e., image marking engine, fuser, etc.) to perform the preprinting passes. After the job scheduler has allocated the proper printing modules to complete the job, the media sheet feeder feeds the required sheets into the printing system 160. Sheets are routed through the input transport module to the lower highway 162 which routes the media sheets to printing modules K2 and C2, respectively, for preprinting passes 164. After the media sheet has passed through the fuser of printing module K2 and C2, the media sheet will be shrunk approximately 80% of the total shrinkage potential. Next, the media sheet is routed from the media sheet output of printing module C2 along the lower highway and re-circulated back along the return highway 166. Subsequently, the media sheet is routed along the upper highway to printing module K1 for black test printing 168. After the sheet passes through the black text image marking engine K1, the sheet will be shrunk approximately 90% of the total shrinkage potential. Next, the sheet is routed through the custom color printing module CC for logo printing 172. Total shrinkage of the media sheet is approximately 100% of total shrinkage potential after printing has been completed. In addition, the media sheet only shrinks approximately 10% during the custom color logo marking process. The net effect of this process is a reduction of mis-registration error relative to the images printed on the media sheet. Subsequent to image marking by printing module CC, the media sheet is routed to the output transport module by the upper highway and from the output transport module to the finisher module 172.

Figure 9:
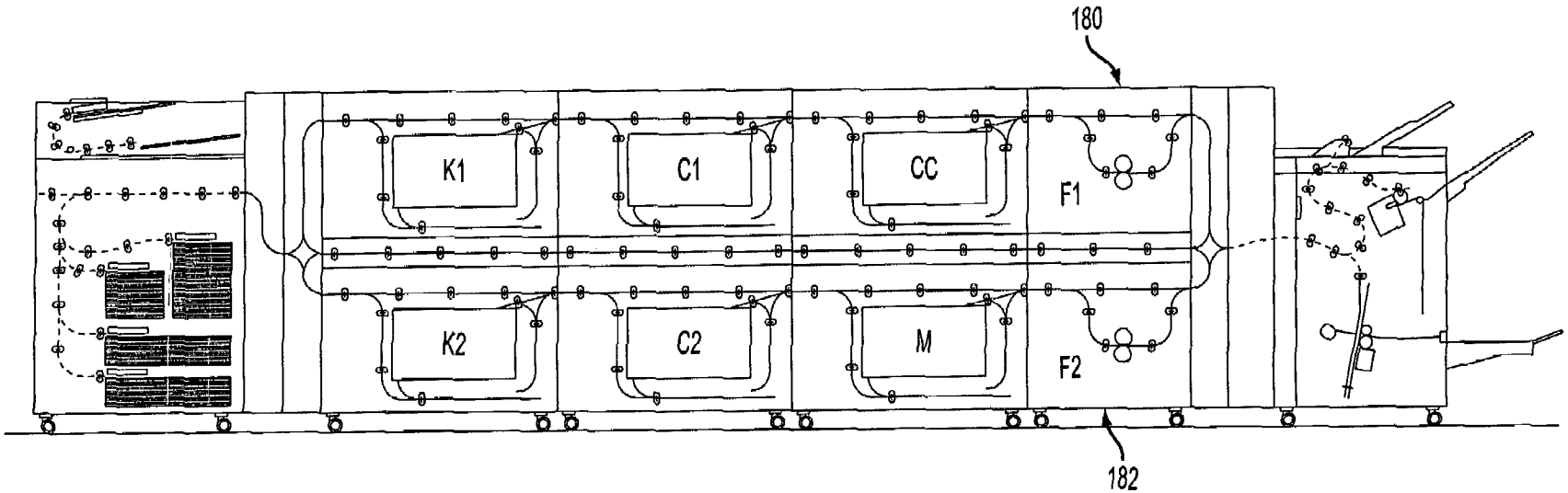
FIG. 9 is a schematic illustration of an exemplary printing system incorporating a media sheet preshrinking or preenlarging process.

FIG. 9 illustrates another exemplary embodiment of this disclosure. The embodiment includes fuser modules F1 180 and F2 182 in addition to the integrated printing modules described with reference to FIG. 6.

Figure 10:
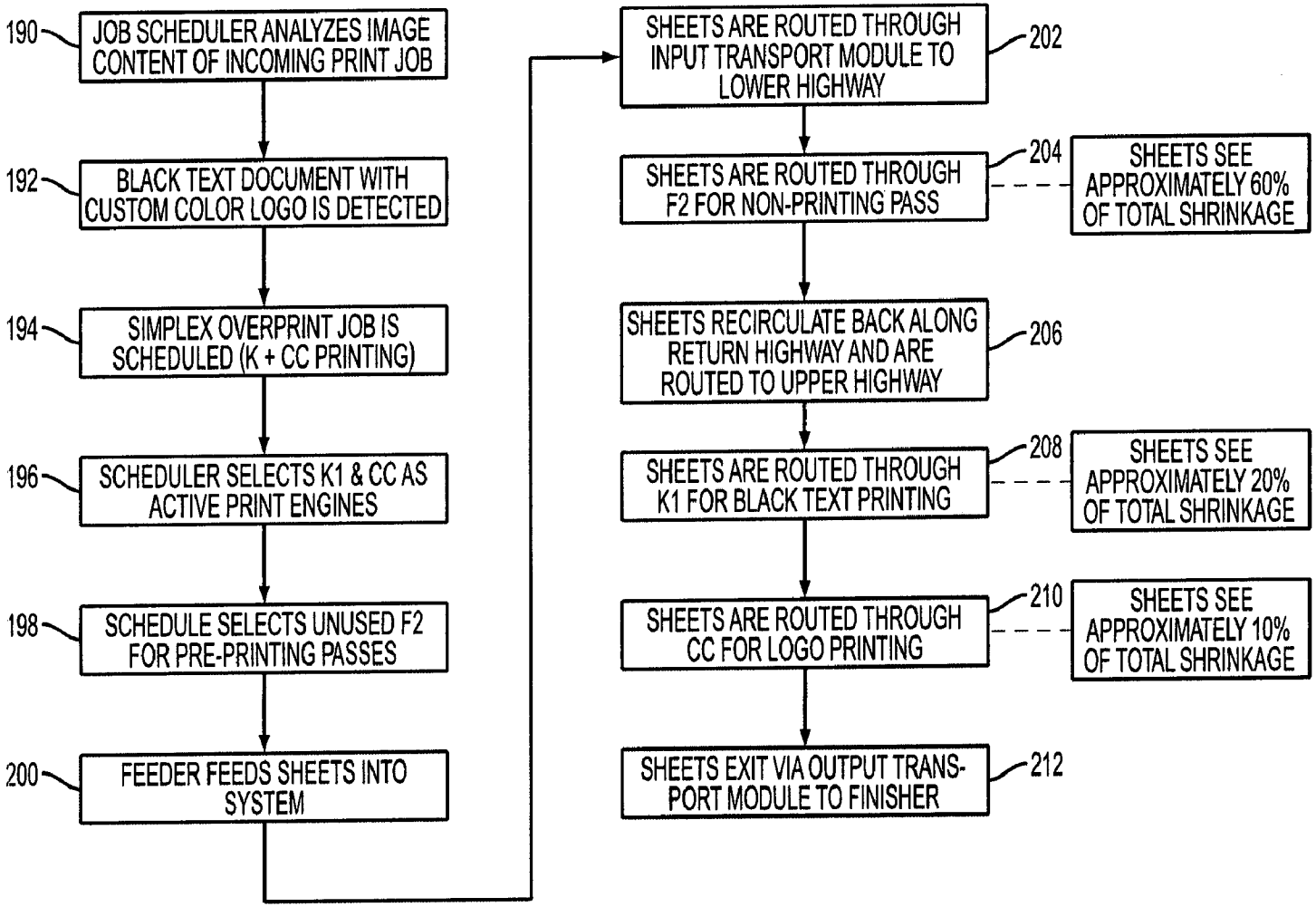
FIG. 10 is a flow chart illustration of an exemplary printing system incorporating a media sheet preshrinking or preenlarging process.

Referencing FIG. 10, a detailed method of operating the embodiment of FIG. 9 is described. FIG. 10 illustrates the flow chart of an overlay printing job which includes black and a custom color logo. The initial print job data is transmitted to the printing system by a network, pc, cd or other computer readable media or device. The job scheduler analyzes the image content of the incoming print job to determine if multiple image marking engines are required 190 to complete the print job. In this example, a black text document with custom color is detected 192. Subsequently, the job scheduler schedules 194 and allocates 196 a black text marking engine K1 and a custom color marking engine CC to perform the simplex overlay print job. The job scheduler next selects 198 unused fuser F2 for preprinting or preshrinking passes. It is to be understood that the job scheduler can select any unused printing module (i.e., marking engine, fuser, etc.) to perform the preprinting passes. After the job scheduler has allocated the proper printing modules to complete the job, the media sheet feeder feeds 200 the required sheets into the printing system. Sheets are routed through the input transport module to the lower highway 202 which routes the media sheets to fuser F2 for preprinting passes 204. After the media sheet has passed through fuser F2, the media sheet will be shrunk approximately 60% of the total shrinkage potential. Next, the media sheet is routed from the media sheet output of the fuser module F2 along with return highway to the upper highway 206. Subsequently, the media sheet is routed along the upper highway to printing module K1 for black text printing 208. After the sheet passes through the black text image marking engine K1, the sheet will be shrunk approximately 80% of the total shrinkage potential. Next, the sheet is routed through the custom color printing module CC for logo printing 210. Total shrinkage of the media sheet is approximately 90% of total shrinkage potential after printing has been completed. In addition, the media sheet only shrinks approximately 10% during the custom color logo marking process. The net effect of the process described with reference to FIG. 10 is a reduction of mis-registration error relative to the images printed on the media sheet. Subsequent to image marking by printing module CC the media sheet is routed to the output transport module by the upper highway and from the output transport module to the finisher module 212.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first and second printing system module, each module configured to mark and fuse an image on a media sheet;

at least one media sheet path interfacing the printing system modules; and a job scheduler configured to execute one or more printing system print jobs, the job scheduler configured to execute computer instructions to perform a method comprising:

receiving a print job to be printed using at least one printing system module;

analyzing the image content of the print job and determining if the print job requires a media sheet to be marked with an image using two or more printing system modules or the print job requires a media sheet to be marked with an image using only one printing system module;

for print jobs requiring two or more printing system modules for marking, routing a media sheet to a first printing system module for preshrinking without marking an image on the media sheet, and subsequently routing the preshrunk media sheet to a second printing system module for marking an image on the media sheet; and for print jobs requiring only one printing system module for marking an image on a media sheet, routing a media sheet to one of the printing system modules for marking an image on the media sheet.

2. The printing system of claim 1, the printing system further comprising:

a media sheet input and a media sheet output associated with each printing system module; and the job scheduler configured to execute a media sheet preshrinking process, the media sheet preshrinking process routing a media sheet on the media sheet path to the first printing system module media sheet input, the first printing system module processing the media sheet to the first printing system module media sheet output without marking an image on the media sheet, and the media sheet preshrinking process subsequently routing the media sheet from the first printing system module output to the first printing system module media input, the media sheet preshrinking process continuing to process the media sheet through the first printing system module without marking an image on the media sheet and routing the media sheet from the first printing system module output to the first printing system module input from about 1 to 10 times, wherein the media sheet shrinks dimensionally in length and width during the media sheet preshrinking process.

3. The printing system of claim 2, wherein the media sheet preshrinking process continues to process the media sheet through the first printing system module without marking an image on the media sheet and routes the media sheet from the first printing system module output to the first printing system module input from about 1 to 5 times, wherein the media sheet shrinks dimensionally in length and width during the media sheet preshrinking or preenlarging process.

4. The printing system of claim 2, wherein the media sheet preshrinking process continues to process the media sheet through the first printing system module without marking an image on the media sheet and routes the media sheet from the first printing system module output to the first printing system module input from about 1 to 2 times, wherein the media sheet shrinks dimensionally in length and width during the media sheet preshrinking or preenlarging process.

5. The printing system of claim 1, the printing system further comprising:

a black and white marking engine, and a color marking engine.

6. The printing system of claim 1, the printing system modules further comprising two or more of the following:

a black and white marking engine;

a CMYK color marking engine;

a custom color engine;

a MICR marking engine.

7. The printing system of claim 1, the printing system further comprising:

the first printing system module comprising a black and white marking engine and a fuser;

the second printing system module comprising a CMYK color marking engine and fuser;

a third printing system module comprising a marking engine and a fuser or a fuser without a marking engine;

a media sheet input and a media sheet output associated with each printing system module; and a media sheet preshrink process, the media sheet preshrink process routing a media sheet on the media sheet path to the third printing system module media sheet input, the third printing system module processing the media sheet to the third printing system module media sheet output without marking an image on the media sheet, and the media sheet preshrink process subsequently routing the media sheet from the third printing system module output to the third printing system module media input, the media sheet preshrink process continuing to process the media sheet through the third printing system module without marking and route the media sheet from the third printing system module output to the third printing system module input one or more times, wherein the media sheet shrinks dimensionally in length and width from an increase in media sheet temperature during the media sheet preshrink process.

8. The printing system of claim 7, further comprising:

a print job requiring black and white printing and color printing;

a media sheet, wherein the job scheduler executes the print job and the media sheet is preshrunk by the media sheet preshrink process utilizing the third printing system module, the media sheet subsequently routed to the first printing system module for marking a first image on the media sheet, and subsequently routing the media sheet to the second printing system module for marking a second image on the media sheet.

9. The printing system of claim 7, wherein the job scheduler executes the print job and the media sheet is preshrunk by the media sheet preshrink process utilizing the third printing system module, the media sheet subsequently routed to the second printing system module for marking a first image on the media sheet, and subsequently routing the media sheet to the first printing system module for marking a second image on the media sheet.

10. The printing system of claim 1, the printing system further comprising:

a print job requiring black and white printing and color printing;

a media sheet;

a first printing system module comprising a black and white marking engine and a fuser;

a second printing system module comprising a CMYK color marking engine and fuser;

a third printing system module comprising a marking engine and a fuser or a fuser without a marking engine;

a media sheet input and a media sheet output associated with each printing system module;

a media sheet preshrink process, the media sheet preshrink process routing a media sheet on the media sheet path to the third printing system module media sheet input, the third printing system module processing the media sheet to the third printing system module media sheet output without marking an image on the media sheet, and the media sheet subsequently routed from the third printing system module output to the first printing system module media input for black and white marking an image on the media sheet and the media sheet subsequently routed to the second printing system module for color marking an image on the media sheet, the media sheet shrinking dimensionally in length and width from an increase in media sheet temperature during each pass through the third, first and second printing system modules, respectively.

11. The printing system of claim 1, the printing system further comprising:

a print job requiring black and white printing and color printing;

a media sheet;

a first printing system module comprising a black and white marking engine and a fuser;

a second printing system module comprising a color marking engine and fuser;

a third printing system module comprising a marking engine and a fuser, or a fuser without a marking engine;

a fourth printing system module comprising a marking engine and a fuser, or a fuser without a marking engine;

a media sheet input and a media sheet output associated with each printing system module;

a media sheet preshrink process, the media sheet preshrink process routing a media sheet on the media sheet path to the third printing system module media sheet input, the third printing system module processing the media sheet to the third printing system module media sheet output without marking an image on the media sheet, and the media sheet subsequently routed from the third printing system module output to the fourth printing system module media sheet input, the fourth printing system module processing the media sheet to the fourth printing system module media sheet output without marking an image on the media sheet, the media sheet subsequently routed from the third printing system module output to the first printing system module media input for black and white marking an image on the media sheet and the media sheet subsequently routed to the second printing system module media input for color marking an image on the media sheet, the media sheet shrinking dimensionally in length and width from an increase in media sheet temperature during each pass through the third, fourth, first and second printing system modules, respectively.

12. A method of printing comprising;

generating a print job to be printed using at least one printing system module;

analyzing the image content of the print job and determining if the print job requires a media sheet to be marked with an image using two or more printing system modules or the print job requires a media sheet to be marked using only one printing system module;

for print jobs requiring two or more printing system modules for marking, routing a media sheet to a first printing system module for preshrinking without marking an image on the media sheet, and subsequently routing the preshrunk media sheet to a second other printing module for marking an image on the media sheet; and for print jobs requiring only one printing system module for marking an image on a media sheet, routing a media sheet to one of the printing modules for marking an image on the media sheet.

13. The method of claim 12, further comprising:

for print jobs requiring two or more printing system modules for media sheet marking, determining which printing system modules are required to be active to execute the media sheet marking, and allocating the remaining printing system modules as available for nonprinting passes for preshrinking of the media sheet before media sheet marking;

routing the media sheet to a first printing system module available for nonprinting passes;

routing the media sheet to a first printing system module determined to be active; and routing the media sheet to a second printing system module determined to be active.

14. The method of claim 12, further comprising:

for print jobs requiring two or more printing system modules for media sheet marking, determining which printing system modules are required to be active to execute the media sheet marking, and allocating the remaining printing system modules as available for nonprinting passes for preshrinking of the media sheet before media sheet marking;

routing the media sheet to a first printing system module available for nonprinting passes;

routing the media sheet to a second printing system module available for nonprinting passes;

routing the media sheet to a first printing system module determined to be active; and routing the media sheet to a second printing system module determined to be active.

15. The method of claim 12, further comprising:

for print jobs requiring two or more printing system modules for media sheet marking, determining which printing system modules are required to be active to execute the media sheet marking, and allocating the remaining printing system modules as available for nonprinting passes for preshrinking of the media sheet before media sheet marking;

routing the media sheet to a first printing system module available for nonprinting passes;

routing the media sheet to a second printing system module available for nonprinting passes;

routing the media sheet to a third printing system module available for nonprinting passes;

routing the media sheet to a first printing system module determined to be active; and routing the media sheet to a second printing system module determined to be active.

16. A xerographic system comprising:

a media sheet feeder module;

a plurality of horizontally and vertically integrated marking devices for applying images to print media, the plurality of marking devices comprising:

a first printing system module comprising a black and white marking engine and a fuser;

a second printing system module comprising a color marking engine and a fuser; and a third printing system module comprising a marking engine and a fuser, or a fuser without a marking engine;

a media sheet input and a media sheet output associated with each printing system module;

a finisher module;

a media sheet path comprising:

a lower highway and/or an upper highway;

a return highway, the highways integrated with the plurality of integrated marking devices, the feeder module, and the finisher module;

a job scheduler for executing one or more printing system print jobs, the job scheduler capable of routing a media sheet to one or more printing system modules for preshrinking without marking an image on a media sheet and subsequently routing the preshrunk media sheet to one or more printing system modules for marking;

a print job requiring black and white printing and color printing;

a media sheet;

a media sheet preshrinking process, the media sheet preshrinking process routing a media sheet from the sheet feeder module on the media sheet path to the third printing system module media sheet input, the third printing system module processing the media sheet to the third printing system module media sheet output without marking an image on the media sheet, and the media sheet subsequently routed from the third printing system module output to the first printing system module media input for black and white marking an image on the media sheet and the media sheet subsequently routed to the second printing system module for color marking an image on the media sheet and routing to the finisher module, the media sheet shrinking dimensionally in length and width during each pass through the third, first and second printing system modules, respectively.

17. The xerographic system of claim 16, further comprising:

a fourth printing system module comprising a marking engine and a fuser, or a fuser without a marking engine, the fourth printing system horizontally and/or vertically integrated with the plurality of marking devices; and the media sheet preshrinking process routing a media sheet from the sheet feeder module on the media sheet path to the third printing system module media sheet input, the third printing system module processing the media sheet to the third printing system module media sheet output without marking an image on the media sheet, and the media sheet subsequently routed from the third printing system module output to the fourth printing system module media sheet input, the fourth printing system module processing the media sheet to the fourth printing system module media sheet output without marking an image on the media sheet, and the media sheet subsequently routed from the fourth printing system module output to the first printing system module media input for black and white marking an image on the media sheet, and the media sheet subsequently routed to the second printing system module for color marking an image on the media sheet and routing to the finisher module, the media sheet shrinking dimensionally in length and width during each pass through the third, fourth, first and second printing system modules, respectively.

* * * * *